US007062196B2

(12) United States Patent
Nanno

(10) Patent No.: US 7,062,196 B2
(45) Date of Patent: Jun. 13, 2006

(54) DUPLEX IMAGE FORMING DEVICE HAVING A REVERSIBLE TRANSPORTATION UNIT INSERTED INTO AN IMAGE FORMING DEVICE

(75) Inventor: Shigeo Nanno, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 225 days.

(21) Appl. No.: 10/728,885

(22) Filed: Dec. 8, 2003

(65) Prior Publication Data

US 2004/0114980 A1 Jun. 17, 2004

(30) Foreign Application Priority Data

Dec. 10, 2002 (JP) ..... 2002-357896

(51) Int. Cl.
*G03G 15/00* (2006.01)

(52) U.S. Cl. ..... 399/107; 399/110; 399/124; 399/392; 399/401

(58) Field of Classification Search ..... 399/107, 399/110, 124, 381, 392, 401
See application file for complete search history.

(56) References Cited

U.S. PATENT DOCUMENTS 5,280,331 A * 1/1994 Namiki ..... 399/124
5,384,619 A * 1/1995 Yokomizo et al. ..... 399/381
5,815,772 A * 9/1998 Saito et al. ..... 399/107
5,839,032 A * 11/1998 Yasui et al. ..... 399/124
6,215,970 B1 * 4/2001 Yoshikawa et al. ..... 399/124
6,564,019 B1 * 5/2003 Ahn et al. ..... 399/110
6,801,749 B1 * 10/2004 Yasui et al. ..... 399/401
2002/0114634 A1 8/2002 Ahn et al.

FOREIGN PATENT DOCUMENTS

JP 7-168407 7/1995
JP 2002-116591 4/2002

* cited by examiner

*Primary Examiner*—William J. Royer
(74) *Attorney, Agent, or Firm*—Westerman, Hattori, Daniels & Adrian, LLP.

(57) ABSTRACT

A duplex image forming device includes an image forming device and a reversible transportation unit. The image forming device includes a paper transportation path, a paper feed unit which transports a paper to the paper transportation path, a printing unit which prints an image onto the paper, and a discharge tray where the paper printed with the image is discharged. The reversible transportation unit includes a main body frame having a contacting surface that contacts against the side of the image forming device, a reversible transportation path which transports-in the paper from a downstream side of the printing unit and transports-out the paper to an upstream side of the printing unit in the paper transportation path, transportation rollers for transporting the paper through the reversible transportation path, and a motor which drives the transportation rollers and is disposed protruding outward from the contacting surface of the main body frame so that at least a part of the motor is disposed in the image forming device when the reversible transportation unit is inserted into the image forming device.

29 Claims, 14 Drawing Sheets

DUPLEX IMAGE FORMING DEVICE HAVING A REVERSIBLE TRANSPORTATION UNIT INSERTED INTO AN IMAGE FORMING DEVICE

FIELD OF THE INVENTION

The present invention relates to an image forming device such as a copy machine and a facsimile machine, and more particularly to a reversible transportation unit used for forming an image on both sides of a paper, and an image forming device for which the reversible transportation unit can be inserted therein.

DESCRIPTION OF RELATED ART

To form an image on both sides of a paper, a conventional image forming device forms an image on one side, reverses the sides of the paper, and forms an image on the other side. Even when a device can form an image on both sides of a paper, an image is not formed on both sides at all times. Therefore, when necessary, a reversible transportation unit, which reverses the sides of the paper on which the image is formed on one side and transports the paper, is attached exteriorly to a main body of the image forming device to carry out an image forming process on both sides of the paper. By attaching the reversible transportation unit exteriorly, there is an advantage that it is not necessary to make a great change in a layout in the main body of the image forming device. On the other hand, there are disadvantages that the image forming device attached with the reversible transportation unit becomes wide and an installation space of the image forming device increases.

Therefore, there is a proposal to not increase the installation space of the image forming device by inserting the reversible transportation unit detachable to the main body of the image forming device. For example, there is a conventional image forming device in which a reversible transportation unit and a re-transportation unit are inserted detachable, and a paper is reversed and transported to carry out a duplex printing. Moreover, there is another conventional image forming device which is inserted with a single-side transportation unit replaceable with a duplex transportation unit. In this case, the installation space of the entire image forming device does not increase, but a layout design in the main body of the image forming device is limited. Therefore, it is necessary to reconsider the layout of a paper feed unit, a printing unit or the like. Moreover, it becomes necessary to secure space for the reversible transportation unit in the device. As a result, the size of the image forming device increases.

SUMMARY OF THE INVENTION

The present invention provides a reversible transportation unit which can reduce the installation space of an image forming device and which can reduce changes in the main body of the image forming device, and an image forming device for which the reversible transportation unit can be inserted therein.

According to the reversible transportation unit and the image forming device of the present invention, the reversible transportation unit is inserted into a side of the image forming device having a paper transportation unit which transports a paper fed from a paper feed unit to a printing unit and transports the paper out to a discharge tray. The paper, which is transported from a downstream side of the printing unit in a transportation path of the paper transportation unit, is transported out to an upstream side of the printing unit. The reversible transportation unit includes a main body frame, transportation rollers for transporting the paper, and a motor for driving the transportation rollers. The motor is disposed in a manner that at least a part of the motor is protruding outward from a contacting surface of the main body frame contacting against the side of the image forming device so that at least the part of the motor is disposed in the image forming device when the reversible transportation unit is inserted into the image forming device. Furthermore, a cover member is provided to cover the part that is protruding to the outside from the contacting surface of the motor.

According to the present invention, a width of the reversible transportation unit (thickness in a horizontal direction from the side of the image forming device) can be reduced by a length so that at least a part of the motor is disposed in the image forming device by protruding outward from the contacting surface of the main body frame. As a result, the installation space of the image forming device can be reduced. Moreover, since the motor for driving the transportation rollers of the reversible transportation unit is disposed at the reversible transportation unit side, it becomes unnecessary to provide a driving system for the reversible transportation unit in the main body of the image forming device. As a result, a designer hardly needs to make a design change.

That is, since the motor, which requires a large space in the reversible transportation unit, is protruded outward with a part of the motor being disposed in the main body of the image forming device when the reversible transportation unit is inserted into the image forming device, the width of the reversible transportation unit can be minimized as much as possible. For example, the width of the reversible transportation unit can be designed based on the width of the transportation rollers. Moreover, by providing in the reversible transportation unit, the driving system for the reversible transportation unit which was conventionally disposed in the main body of the image forming device, the main body of the image forming device can be downsized. Furthermore, the driving system can be set only when necessary, and since the driving system is not set in the main body of the image forming device at all times, the driving system in the main body of the image forming device can be simplified.

Moreover, by covering the part of the motor protruding outward with the cover member, when the reversible transportation unit is spaced from the image forming device for removing the reversible transportation unit or for solving a paper jam, the heated motor is not exposed, and contact with the motor can be prevented.

Moreover, an engaging unit which engages with the side of the image forming device and the motor are disposed on the main body frame in a manner to be located above the paper reversible transportation path when the reversible transportation unit is inserted into the image forming device. As a result, the reversible transportation unit is inserted into the main body of the image forming device under a stabilized state. That is, by disposing the heavy motor and the engaging unit in the reversible transportation unit, the reversible transportation unit can be engaged with the image forming device at a position close to a barycentric position, and the reversible transportation unit can be provided under an even more stabilized state.

DETAILED DESCRIPTION OF THE PREFERRED EMBODIMENTS

The embodiments of the present invention will be described in detail. Further, in this specification, a "side" of a device main body means the sides other than an upper side and a lower side, and includes a front side and a back side.

Figure 1:
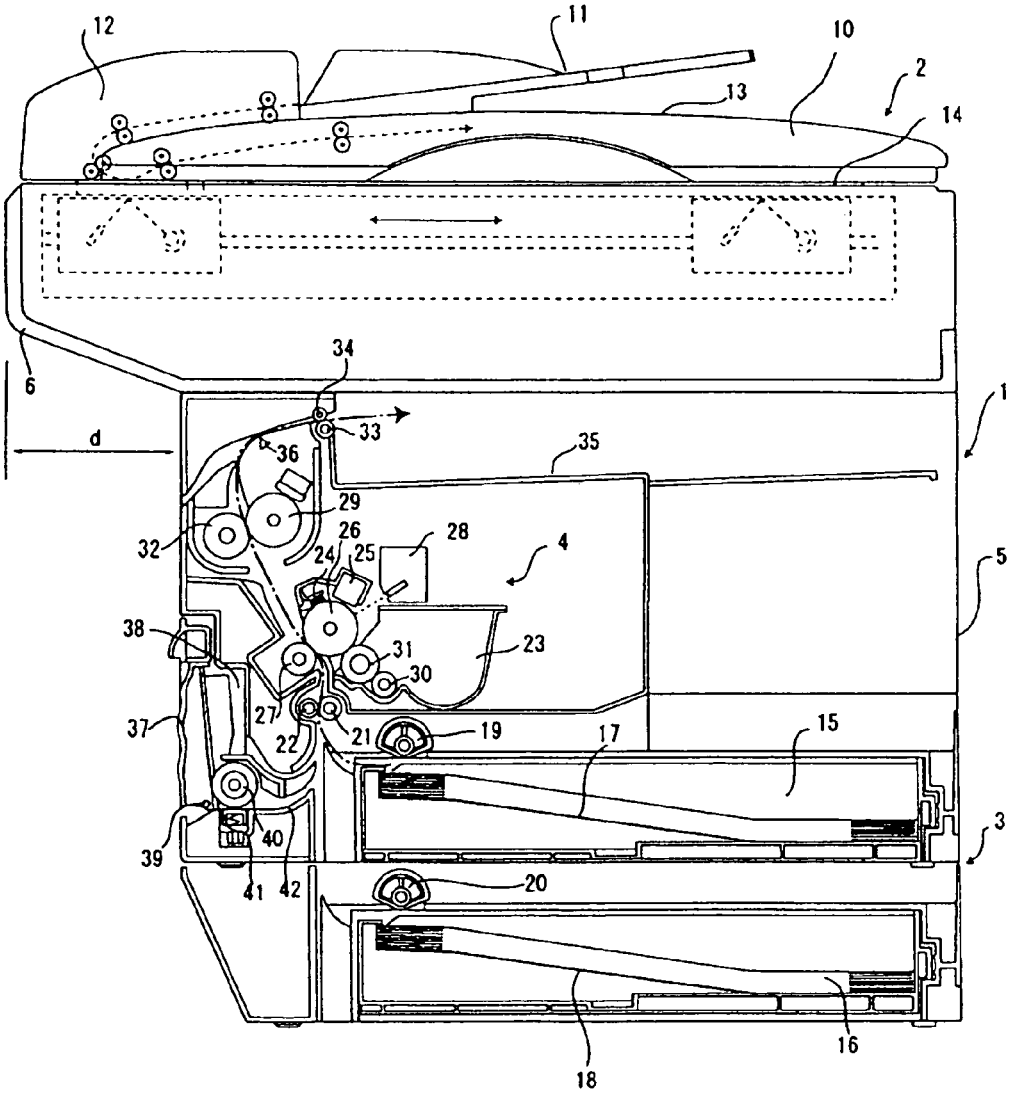
FIG. 1 is a schematic cross-sectional view showing the entire image forming device for which a reversible transportation unit is not inserted therein.
Figure 2:
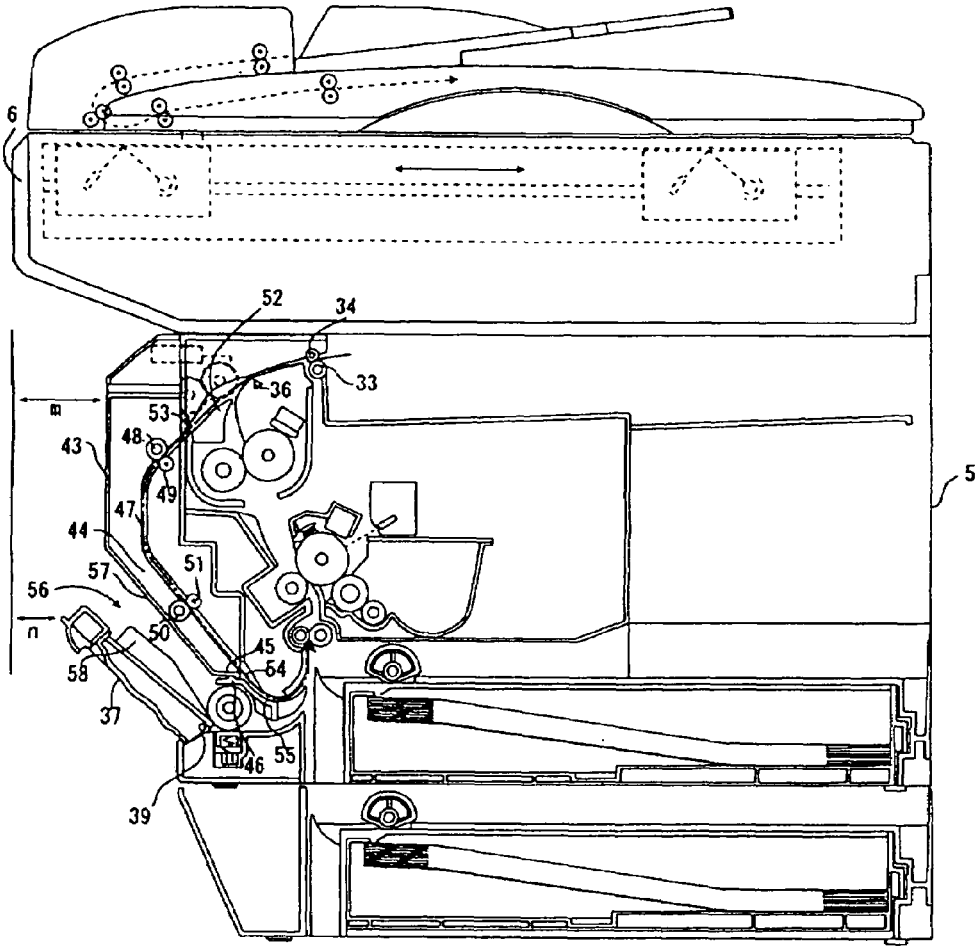
FIG. 2 is a schematic cross-sectional view showing the entire image forming device for which the reversible transportation unit is inserted therein.

FIG. 1 is a schematic cross-sectional view showing an image forming device 1 according to an embodiment of the present invention. FIG. 2 is a schematic cross-sectional view showing a state in which a reversible transportation unit 43 is inserted in the image forming device 1. A scanning unit 2 is disposed in an upper part of the image forming device 1. A paper feed unit 3 and a printing unit 4 are disposed in a lower part of the image forming device 1 in this order from the lower side.

In the scanning unit 2, a tray 11 is disposed on a cover 10. An original document placed on the tray 11 is transported by a transportation device 12 to a position facing a scanner, and a scanning operation is carried out. Then, the original document is discharged onto a discharge tray 13. When scanning an original document other than a sheeted document such as a booklet, the cover 10 is opened upward, a scanning face of the booklet is placed on a flat bed platen 14, and the booklet is scanned. The above-described structure is the same as that of a scanning device having an Auto Document Feeder (ADF) type and a flat bed type.

In the paper feed unit 3, paper feed cassettes 15 and 16 are disposed vertically one on the other, and multiple sheets of papers of prescribed sizes are stacked on flappers 17 and 18 of the paper feed cassettes 15 and 16 respectively. The right ends of the flappers 17 and 18 are supported rotatable on the frame by hinges. Pick-up rollers 19 and 20 are disposed at the left side. The flappers 17 and 18 are pushed upward so that an upper surface of the stacked papers contacts against the pick-up rollers 19 and 20. When the pick-up rollers 19 and 20 are rotated under this state, the papers are fed to a paper transportation path one sheet at a time by a frictional force.

The fed paper is transported to the printing unit 4 by a feed roller 21 and a press roller 22. To print an image onto the transported paper, the printing unit 4 includes a toner case 23, a memory erasing brush 24, a charger 25, a photoconductive drum 26, a transfer roller 27, an exposure head 28, and a fuser roller 29. First, the surface of the photoconductive drum 26 is charged uniformly by the charger 25. The charged photoconductive drum 26 is exposed by the exposure head 28 according to an image printing signal, and an electrostatic latent image is formed on the photoconductive drum 26. Next, the toner stored in the toner case 23 is transferred from a supply roller 30 via a developing roller 31 to the electrostatic latent image on the photoconductive drum 26, and the electrostatic latent image is visualized. Then, the toner image formed on the surface of the photoconductive drum 26 is transferred onto a paper by the transfer roller 27. The transferred toner image is sandwiched and heat-pressed by the fuser roller 29 and a press roller 32, and fused on the paper. The fused paper is sandwiched between a discharge roller 33 and a press roller 34 and transported out onto a paper discharge tray 35.

In FIG. 1, the dashed line shows the paper transportation path from the paper feed unit 3 to the paper discharge tray 35. A paper end detecting sensor 36 is disposed to the upstream side of the discharge roller 33.

Meanwhile, a storage opening 38 is provided at a side of the image forming device 1. A manual paper feed tray 37 is disposed in the storage opening 38. FIG. 1 shows a state in which the manual paper feed tray 37 is locked to the device main body by a locking member (not shown), and located at a locked position. The manual paper feed tray 37 is supported by a swing shaft 39 in a manner capable of swinging, and swings to an unlocked position shown in FIG. 2. A pick-up roller 40 for transporting the manually fed paper and a pad 41 contacting against the pick-up roller 40 are disposed in a lower part of the storage opening 38. The manually fed paper is fed by the rotation of the pick-up roller 40, and the paper is transported along a guide 42 to the feed roller 21 and the press roller 22.

FIG. 2 shows a state in which the manual paper feed tray 37 is swung outward with the swing shaft 39 as the center and spaced from the storage opening 38, i.e., a state in which the manual paper feed tray 37 is located at an unlocked position. The reversible transportation unit 43 is inserted above the manual paper feed tray 37. A protrusion 44 is formed in a lower part of the reversible transportation unit 43, and the protrusion 44 is inserted into the storage opening 38. A driving mechanism such as a motor to be described later is provided in the upper part of the reversible transportation unit 43, and the driving mechanism is inserted in the device main body. A claw (not shown) is formed on a bottom face 45 of the protrusion 44, and the claw is caught by a supporting table 46 of the main body of the image forming device when the reversible transportation unit 43 is inserted into the image forming device 1. Under a state in which the reversible transportation unit 43 is inserted in the image forming device 1, the protrusion 44 is protruding to the device main body side from the surface of the reversible transportation unit 43 that is contacting against the outermost side of the image forming device 1.

A reversible transportation path 47 having a shape of approximately a horseshoe is formed in the reversible transportation unit 43. A feed roller 48 and a press roller 49 are disposed in the upper slanting transportation path, and a feed roller 50 and a press roller 51 are disposed in the lower slanting transportation path. The paper is transported through the reversible transportation path by these two pairs of transportation rollers 48–51. At least one of the feed roller 50 and the press roller 51 is disposed in the protrusion 44 to be located at a space in the storage opening 38.

In the image forming device 1, a reversible transporting-out path is formed from the discharge roller 33 via a lower guide 52 to a paper transportation outlet 53. Moreover, in the storage opening 38, a reversible transporting-in path is formed above a manual paper feed opening from a paper transportation inlet 54 via a guide 55 to the feed roller 21. Therefore, when the reversible transportation unit 43 is inserted into the image forming device 1, the reversible transporting-out path, the reversible transportation path 47, and the reversible transporting-in path are connected, and a transportation path is formed as shown with the dashed line in FIG. 2.

When controlling the reversible transportation of the paper, the discharge roller 33 is driven, and the paper, which an image is formed on one side, is once discharged toward the discharge tray 35. Then, in response to an output of the paper end detecting sensor 36, the discharge operation is stopped. At this time, the lower edge of the paper is sandwiched between the discharge roller 33 and the press roller 34. Then, a motor in the reversible transportation unit 43 is driven, the discharge roller 33 is rotated to transport the paper in a reverse direction, and the paper is transported with the lower edge of the paper as a head through the reversible transporting-out path to the paper transportation outlet 53. The feed roller 48 and the feed roller 50 rotate in accordance with the reverse rotation of the discharge roller 33. The paper is transported through the reversible transportation path 47, transported from the paper transportation inlet 54 to the reversible transporting-in path, and contacted against the feed roller 21 again. Then, an image is formed on the other side (back side) of the paper by the printing unit 4, and the images are formed on both sides of the paper.

A paper guide opening 56 is formed between the manual paper feed tray 37 and an opposing surface 57 of the reversible transportation unit 43 for manually feeding the paper. By forming the paper guide opening 56, both the manual paper feeding operation and the reversible transportation operation can be carried out without removing the manual paper feed tray 37 from the device main body. Moreover, since the paper guide opening 56 can be confirmed visually from diagonally above, a paper can be easily guided to a paper feed opening. Side guides 58 for positioning a paper are disposed on the upper surface of the manual paper feed tray 37. By sliding and positioning the side guides 58 according to the paper size, the manual paper feeding operation can be carried out accurately.

In the image forming device 1, a paper transportation path in the device main body is formed in a vertical direction upward from the paper feed unit 3 and connected to the discharge tray 35 located above. As described above, by forming the paper transportation path to extend in the vertical direction, the distance of the transportation path can be reduced, and the device main body can be downsized. Therefore, the photoconductive drum 26, the transfer roller 27 and the fuser roller 29 of the printing unit 4 are also arranged in a vertical direction along the paper transportation path, and laid out at one side in a width direction (in the example of FIGS. 1 and 2, the left side) of the device main body. By adopting such a layout, the installation space of the device main body can be brought closer to the maximum size of the papers stacked in the paper feed unit 3, and the device main body can be downsized. Meanwhile, since the original transportation device (ADF) 12 is disposed on the left side part of the flat bed platen 14, when comparing the width in the longitudinal direction, as shown in FIG. 1, the original scanning unit 2 is wider than a housing 5 of the image forming device, which is located below and disposed with the paper feed unit 3 and the printing unit 4, by a distance "d".

Conventionally, to cover such a difference in the width for the purpose of design, the width of the housing 5 was formed to be the same as the width of the scanning unit 2. However, in the present embodiment, an outer frame 6 of the scanning unit 2 is disposed to protrude outward from the side frame of the housing 5, at the side where the fuser roller 29 is provided in proximity to the side frame. By adopting such a layout, even when the fuser roller 29 is heated, since space is formed to the outside of the side frame, the heat can be released efficiently. As described above, if the outer frame 6 of the scanning unit 2 is not protruding outward from the side frame of the device main body, there are cases where the image forming device 1 is disposed with the side frame of the fuser roller side being in close contact with a wall. In such a case, the heat is not released efficiently from the fuser roller 29, and there is a possibility to cause a failure. However, in the present embodiment, such a problem can be avoided.

Moreover, as shown in FIG. 2, the outermost position in the horizontal direction from the side frame inserted with the reversible transportation unit 43 is set to be located inward from the protrusion of the outer frame 6 of the scanning unit 2. That is, the outermost position of the reversible transportation unit 43 is set to be located inward by a distance "m" from a vertical surface passing through the outermost position of the protrusion of the outer frame 6. By setting in such a way, the space formed by the protrusion of the outer frame 6 can be utilized effectively. Moreover, if the image forming device 1 is placed so that the side, which is inserted with the reversible transportation unit 43, faces a passage of a person, the protrusion of the outer frame 6 restricts a path of a person and prevents a person from contacting against the reversible transportation unit 43. In other words, since the protrusion of the outer frame 6 is recognized, even if the reversible transportation unit 43 is inserted, the reversible transportation unit 43 does not interfere with the path of a person.

Moreover, the outermost position of the manual paper feed tray 37 under the unlocked state is set inward by a distance "n" from the vertical surface passing through the outermost position of the protrusion of the outer frame 6. By setting in such a way, as in the case of the reversible transportation unit 43, the space formed by the protrusion of the outer frame 6 can be utilized effectively and can be prevented from interfering with the path of a person.

Figure 3:
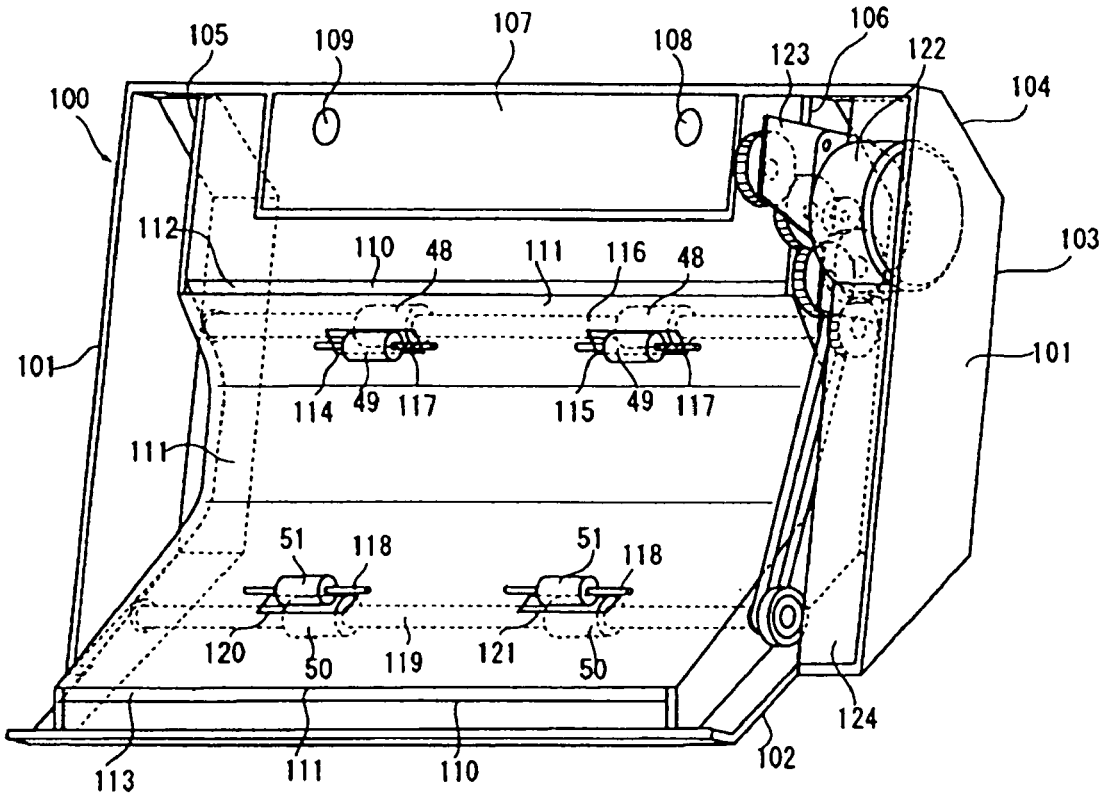
FIG. 3 is a perspective view showing the reversible transportation unit.
Figure 4:
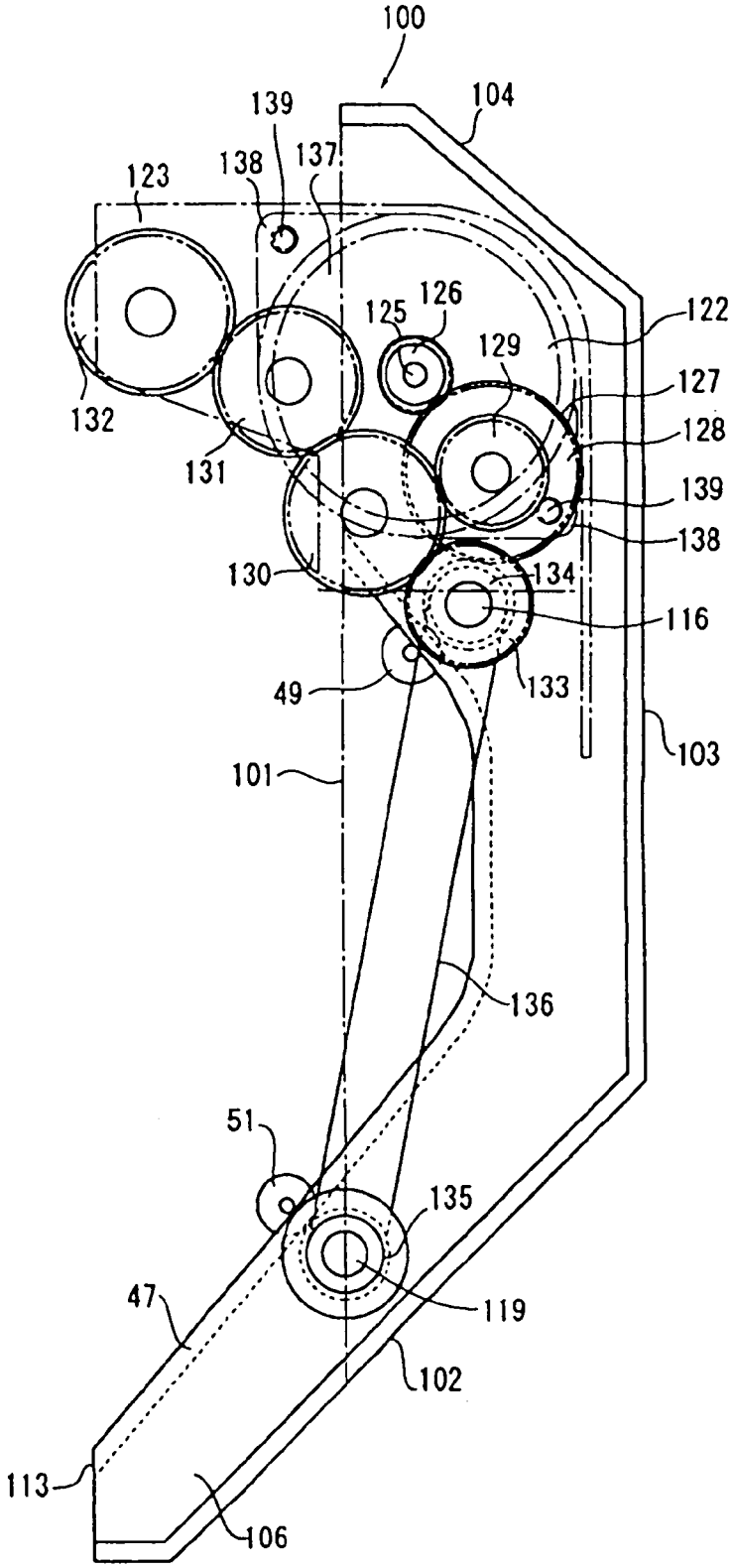
FIG. 4 is a schematic cross-sectional side view showing the reversible transportation unit.

FIG. 3 is a perspective view when viewing the reversible transportation unit 43 from inside. FIG. 4 is a schematic view of a driving mechanism when viewing the reversible transportation unit 43 from its side.

As shown in FIG. 3, left and right side frames 101, a lower frame 102, a rear frame 103 and an upper frame 104 are formed as one body to form a main body frame 100. The lower frame 102, the rear frame 103 and the upper frame 104 are formed between the left and the right side frames 101 from a lower side in this order. In addition, side guides 105 and 106 are formed inside the main body frame 100 along the reversible transportation path and fixed approximately in parallel with the side frames 101. A main body supporting plate 107 is disposed to the inner surface of the upper frame 104. Holes 108 and 109 are drilled through the main body supporting plate 107 to fix the reversible transportation unit 43 on the device main body by screws or the like. The side guides 105 and 106 curving toward the rear frame 103 are formed along the reversible transportation path 47. An outer guide 110 and an inner guide 111 are disposed between the side guides 105 and 106 along the curved shape in parallel with one another with a prescribed interval. The inner guide 111 is a guide located closer to the device main body, and the outer guide 110 is a guide located closer to the main body frame 100. The reversible transportation path 47, and a transportation inlet 112 and a transportation outlet 113 are formed in an area surrounded by four guides, the side guides 105 and 106, the outer guide 110 and the inner guide 111. The transportation inlet 112 is connected to the paper transportation outlet 53 of the device main body, and the transportation outlet 113 is connected to the paper transportation inlet 54 of the device main body.

As described above, two pairs of transportation rollers, the feed rollers 48 and the press rollers 49, and the feed rollers 50 and the press rollers 51, are disposed in the reversible transportation path 47. The feed rollers 48 are fixed on a roller shaft 116. The roller shaft 116 is supported rotatable between the side guides 105 and 106. The press rollers 49 are fixed on roller shafts 117. The roller shafts 117 are supported rotatable by the inner guide 111. The press rollers 49 are contacting against the feed rollers 48 at openings 114 and 115 formed through the inner guide 111.

Moreover, the feed rollers 50 are fixed on a roller shaft 119. The roller shaft 119 is supported rotatable between the side guides 105 and 106. The press rollers 51 are fixed on roller shafts 118, and the roller shafts 118 are supported rotatable by the inner guide 111. The feed rollers 50 are contacting against the press rollers 51 at openings 120 and 121 formed through the inner guide 111.

For driving the feed rollers 48 and 50, a gear supporting plate 123 having a motor 122 and a gear mechanism are fixed between the side frame 101 and the side guide 106. A hole is drilled through the gear supporting plate 123, and under a state in which a motor shaft is protruding from the hole, the motor 122 is attached to the gear supporting plate 123. A part of the motor 122 is protruding outward from the side of the side frame 101. A cover member 124 is inserted along the side of the side frame 101 so that the cover member 124 covers the protrusion.

FIG. 4 is a side view when viewing the reversible transportation unit 43 from the side frame 101. To facilitate the comprehension of the gear mechanism, the side frame 101, the motor 122 and the gear supporting plate 123 are shown with dashed lines. As described above, the motor shaft 125 of the motor 122 is protruding from the hole of the gear supporting plate 123, and disposed to the opposite side of the side where the motor 122 is disposed on the supporting plate 123. A driving gear 126 is fixed on the motor shaft 125, and a double-reduction gear 127 is engaged with the driving gear 126. The double-reduction gear 127 consists of a larger diameter part 128 and a small diameter part 129, and is attached rotatable to the gear supporting plate 123. The driving gear 126 is engaged with the large diameter part 127.

A first transfer gear 130 is engaged with the small diameter part 129, a second transfer gear 131 is engaged with the first transfer gear 130, and a third transfer gear 132 is engaged with the second transfer gear 131. The transfer gears 130 through 132 are attached rotatable to the gear supporting plate 123. As shown in FIG. 4, the transfer gears 130 through 132 are disposed to protrude outward (in FIG. 4, leftward) from the edge of the side frame 101. By disposing the transfer gears 130 through 132 to protrude outward, when the reversible transportation unit 43 is inserted into the image forming device 1 a driving transfer mechanism inside the device main body and the third transfer gear 132 engage with one another, and a driving force of the motor 122 is transferred.

A roller driving gear 133 is also engaged with the small diameter part 129. The roller driving gear 133 is fixed to the roller shaft 116 attached with the feed rollers 48. A pulley 134 is protruding from the side guide 106 of the roller driving gear 133. A pulley 135 having the same diameter as the diameter of the pulley 134 is fixed to the roller shaft 119 having the feed rollers 50. An endless belt 136 is wound around the pulley 134 and the pulley 135.

When the motor 122 is driven and the motor shaft 125 rotates, the driving gear 126 rotates and the double-reduction gear 127 rotates. Therefore, the rotation of the small diameter part 129 is transferred from the first transfer gear 130 to the roller driving gear 133, and the feed rollers 48 rotate. Since the pulley 134 also rotates at the same time, the pulley 135 rotates via the endless belt 136, and the feed rollers 50 rotate. As described above, the reversible transportation of the paper is carried out by the rotation of the feed rollers 48 and 50.

In the motor 122, two attaching plates 138 are disposed symmetrically with the motor shaft 125 as the center. By fixing the attaching plates 138 respectively on the gear supporting plate 123 by fixing members 139, the motor 122 is fixed on the gear supporting plate 123. The gear supporting plate 123 is fixed on the rear frame 103 by an attaching member (not shown). Under a state in which the gear supporting plate 123 is fixed, a part 137 of the motor 122 is protruding outward from the inner edge of the side frame 101 (from the left side edge in FIG. 4).

Figure 5:
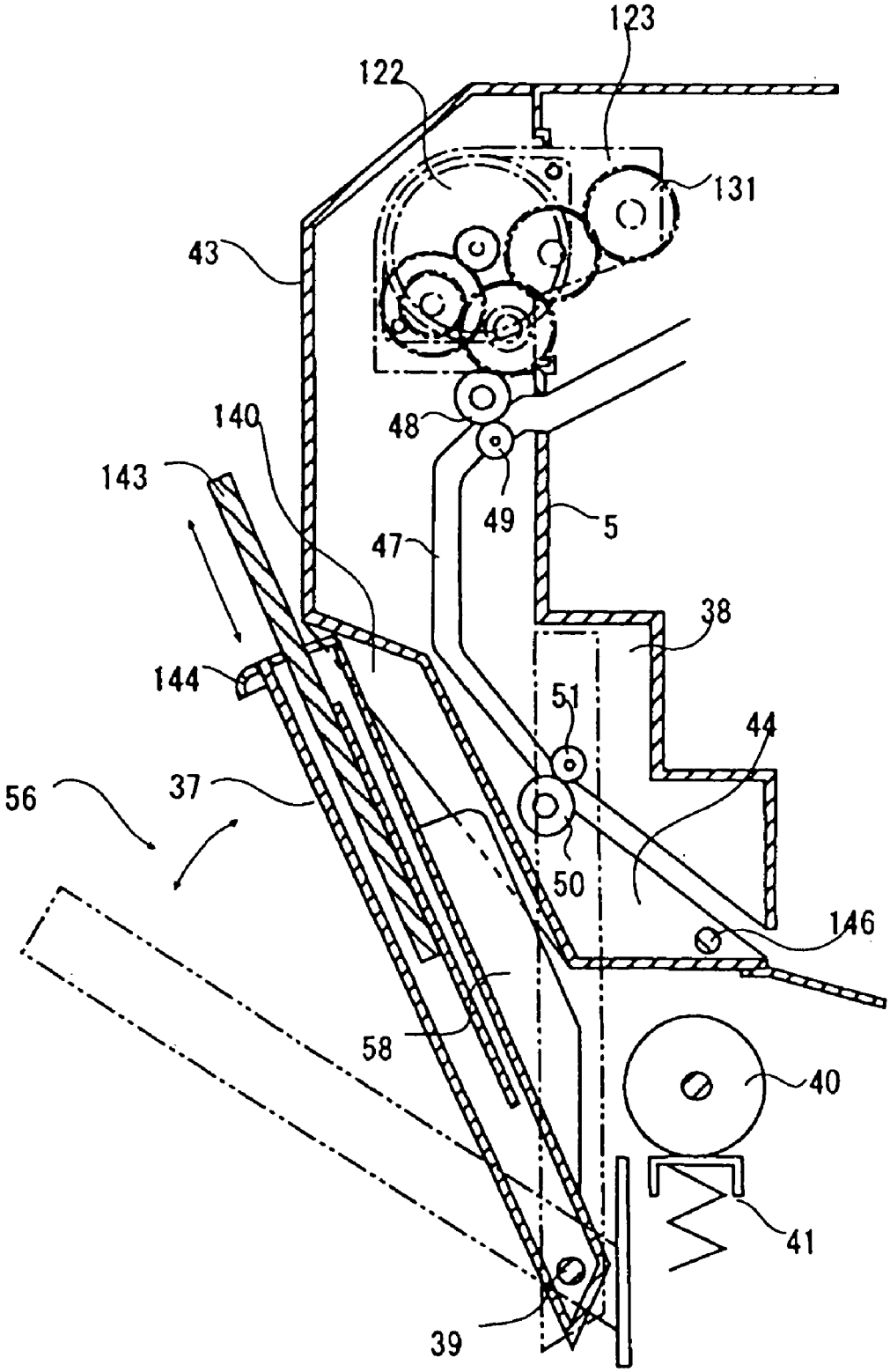
FIG. 5 is a schematic partial cross-sectional view showing a state in which the reversible transportation unit is inserted.
Figure 6:
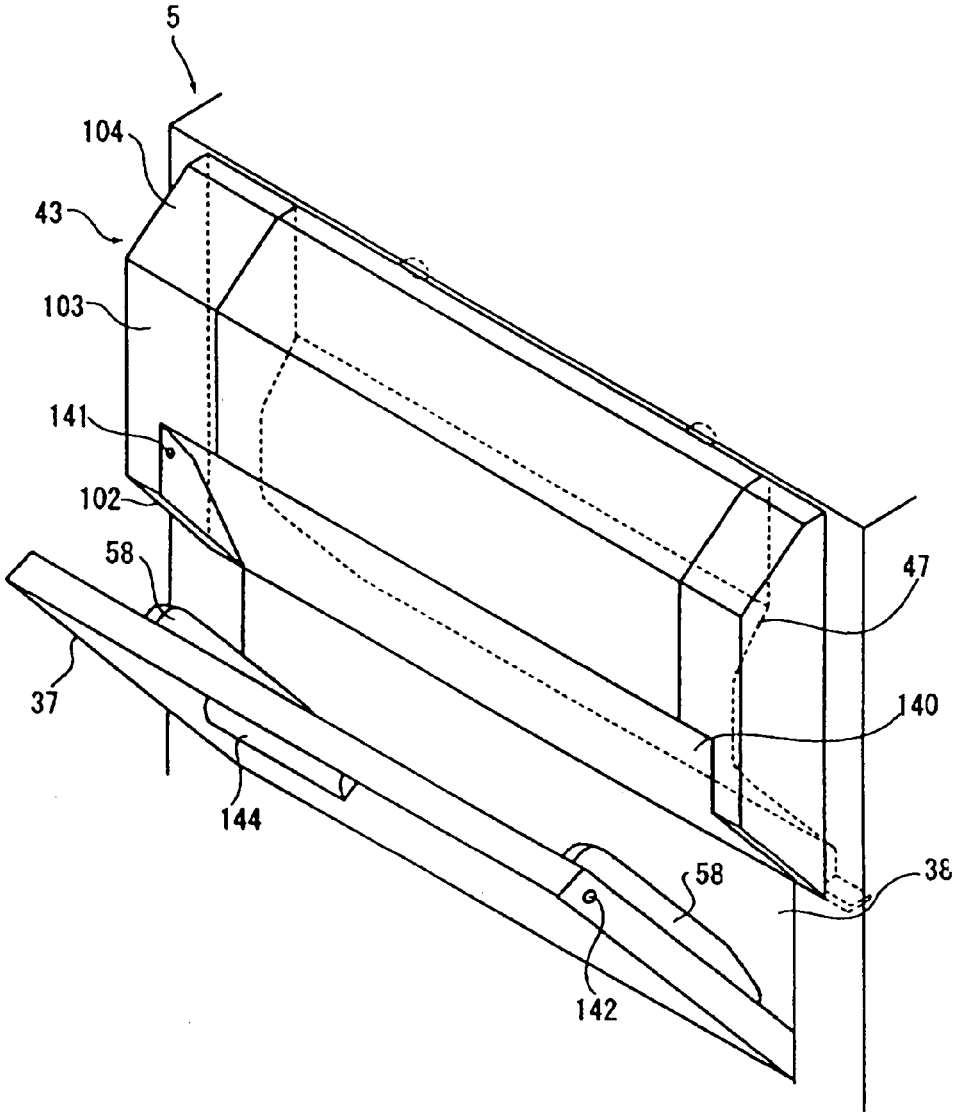
FIG. 6 is a perspective overview showing a state in which the reversible transportation unit is inserted.

FIG. 5 is a schematic partial cross-sectional view showing a state in which the reversible transportation unit 43 is inserted into the device main body. FIG. 6 is a perspective overview showing a state in which the reversible transportation unit 43 is inserted into the device main body. In the upper part of the reversible transportation unit 43, a part of the motor 122 protruding outward, and a part of the driving transfer mechanism such as the third transfer gear 132 or the like attached to the gear supporting plate 123 are inserted into the device main body. Moreover, in the lower part of the reversible transportation unit 43, the protrusion 44 is inserted into the storage opening 38 of the device main body.

In the main body frame 100 of the reversible transportation unit 43, a storage unit 140 consisting of the lower frame 102 and the rear frame 103 is formed, and the manual paper feed tray 37 is stored in the storage unit 140. As shown in FIG. 6, the storage unit 140 is formed in a concave shape having a width that is the same as the width of the manual paper feed tray 37. Both sides of the storage unit 140 are approximately in parallel with the side frames 101. Engaging protrusions 141 are formed on a surface of each of the side frames 101 facing the storage unit 140.

As shown in FIG. 5, an extension plate 143 is disposed slidable inside the manual paper feed tray 37, and a handle 144 is provided on the upper part of the manual paper feed tray 37. When the manual paper feed tray 37 is swung with the swing shaft 39 as the center and stored into the storage unit 140, the engaging protrusions 141 engage respectively with the engaging concave parts 142 formed on both sides of the manual paper feed tray 37, and the manual paper feed tray 37 is held in the storage unit 140.

Figure 7:
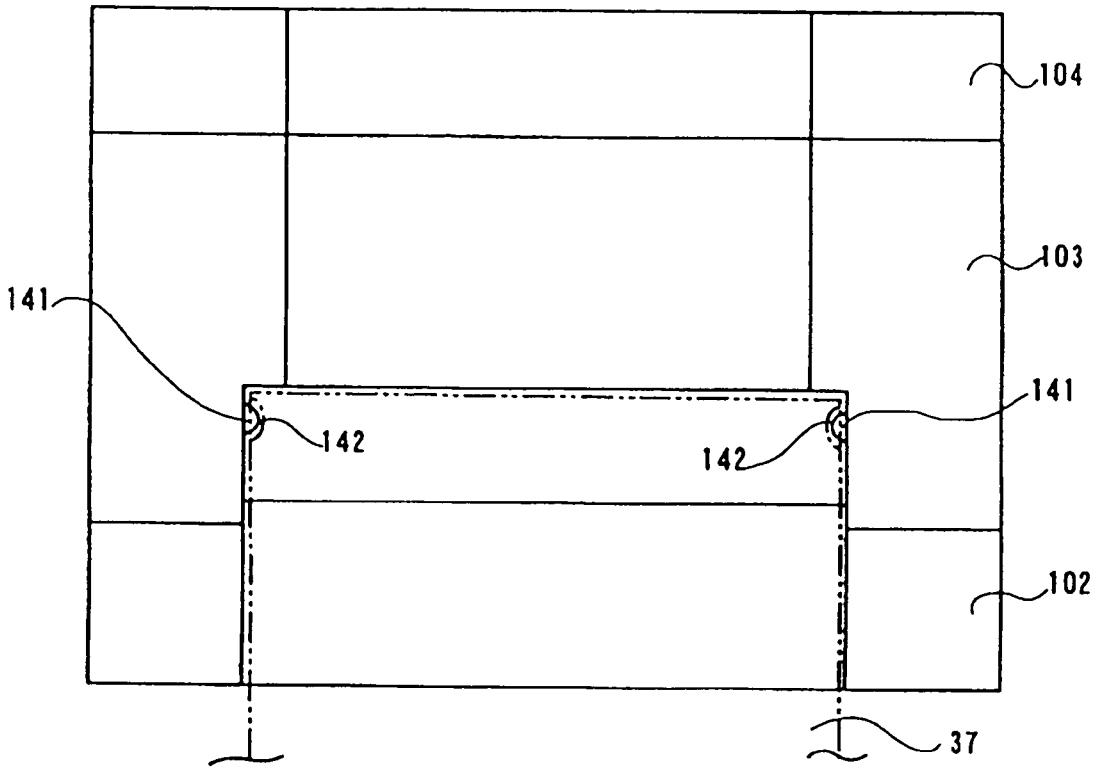
FIG. 7 is a view for describing a state in which a manual paper feed tray is stored in the reversible transportation unit.
Figure 8:
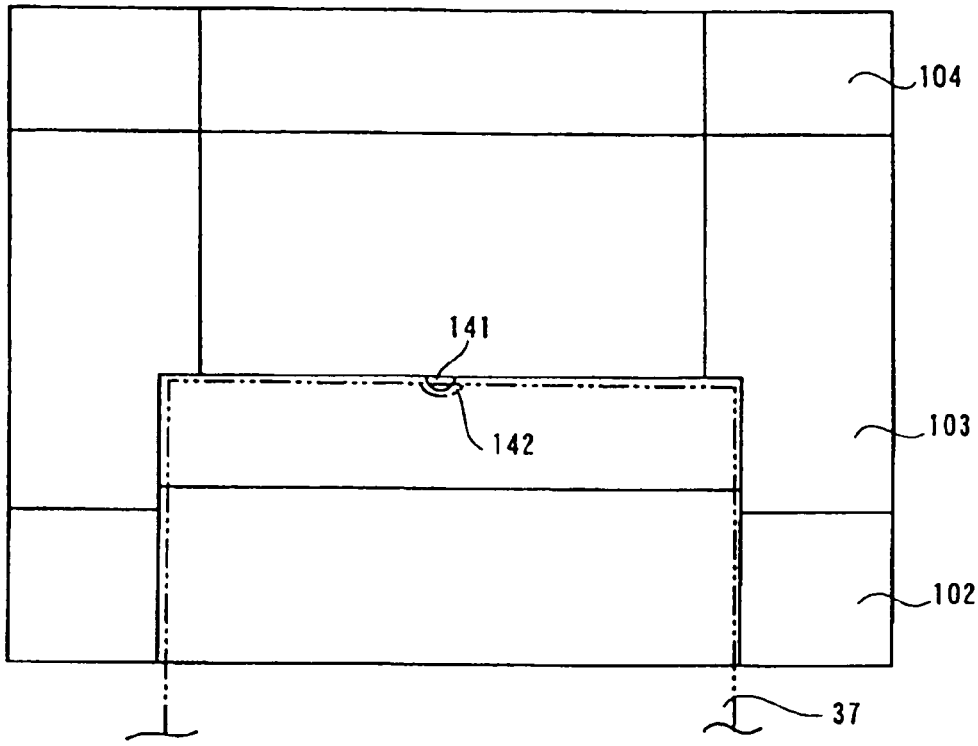
FIG. 8 is a view for describing another example of the state in which the manual paper feed tray is stored in the reversible transportation unit.

FIG. 7 is a perspective overview when viewing the manual paper feed tray 37 stored in the storage unit 140 from the rear side of the reversible transportation unit 43. The engaging protrusions 141 provided at both sides of the storage unit 140 engage with engaging concave parts 142 provided at both sides of the manual paper feed tray 37 to hold the manual paper feed tray 37. As a method for holding the manual paper feed tray 37, as shown in FIG. 8, the engaging protrusion 141 can be provided on an upper part of the storage unit 140, and the engaging concave part 142 can be provided on an upper part of the manual paper feed tray 37 to hold the manual paper feed tray 37. Further, if the manual paper feed tray 37 can be held by the storage unit 140, other methods can be adopted, and the present invention is not limited to the disclosed example.

Figure 9:
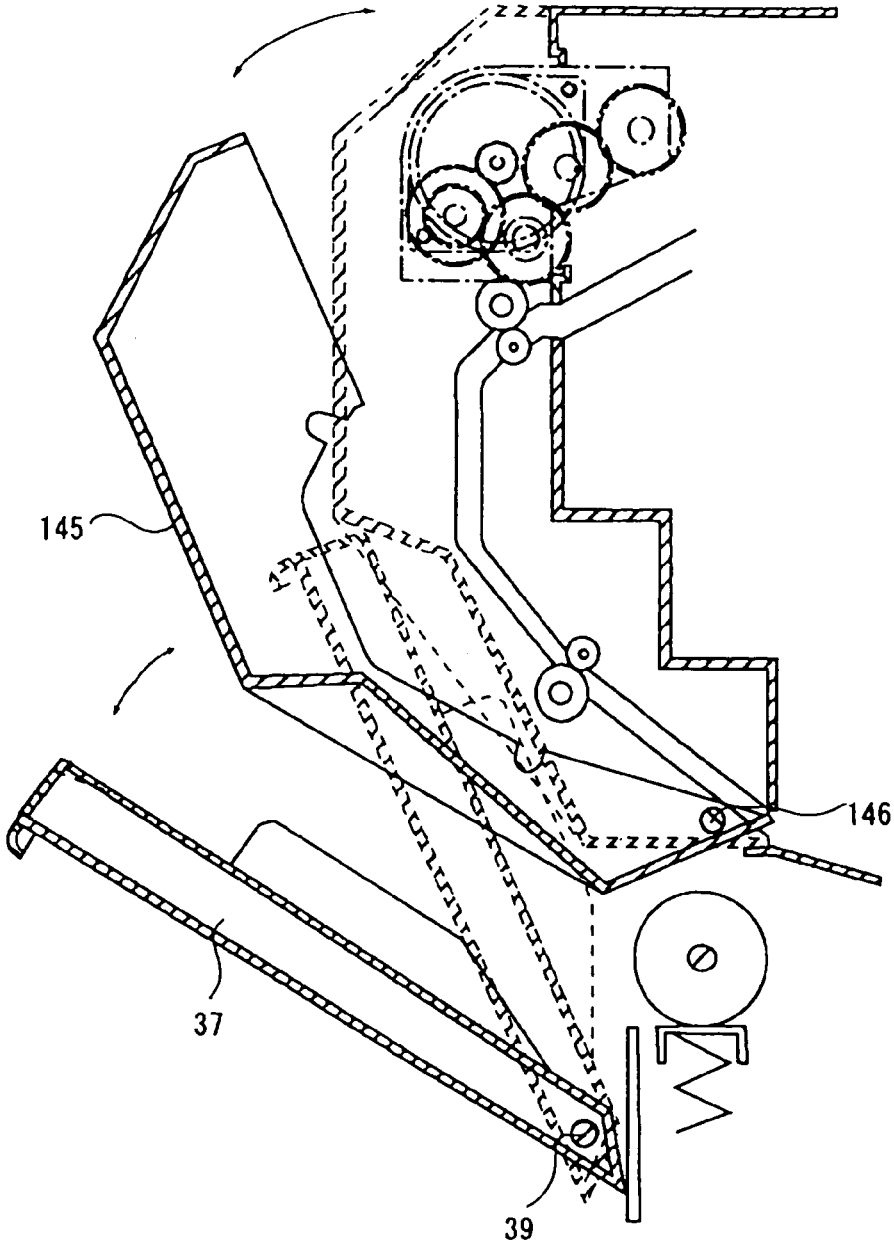
FIG. 9 is a view for describing a state in which a cover member of the reversible transportation unit is opened.

Moreover, it is preferable to form the center part of the rear frame 103 and the lower frame 102 of the reversible transportation unit 43 as a cover part 145, and the cover part 145 to be openable and closable with a swing shaft 146 as the center. As a result, a jammed paper can be easily removed from the reversible transportation path 47. In addition, since the swing shaft 39 of the manual paper feed tray 37 and the swing shaft 146 of the cover member 145 are disposed at different positions, as shown in FIG. 9, when opening the cover member 145, the engaging protrusion 141 and the engaging concave part 142 are automatically separated from one another, and the manual paper feed tray 37 also becomes under the unlocked state.

Figure 10:
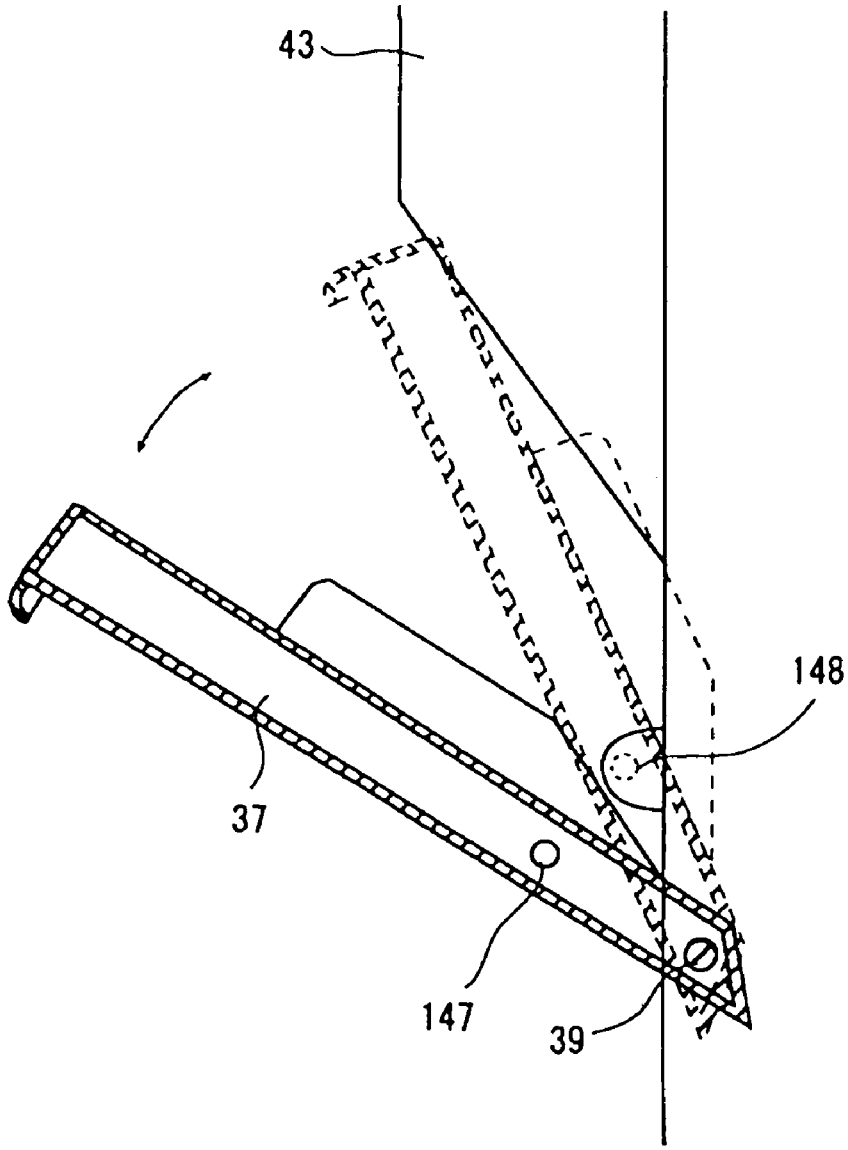
FIG. 10 is a view for describing an example where the manual paper feed tray is held by a device main body.

In the above-described embodiment, the reversible transportation unit 43 includes a holding unit for holding the manual paper feed tray 37. When the manual paper feed tray 37 is opened to the maximum position, the outer wall of reversible transportation unit 43 is positioned inside the end portion of the manual paper feed tray 37 (position at the unlocked state as shown in FIG. 2). However, such a holding unit can be provided to the device main body side. For example, as shown in FIG. 10, an engaging protrusion 147 can be protruding from an intermediate part of the manual paper feed tray 37, and a bracket 148 having an engaging concave part to be engaged with the engaging protrusion 147 can be formed on the device main body. As a result, the manual paper feed tray 37 can be held by the bracket 148.

Figure 11:
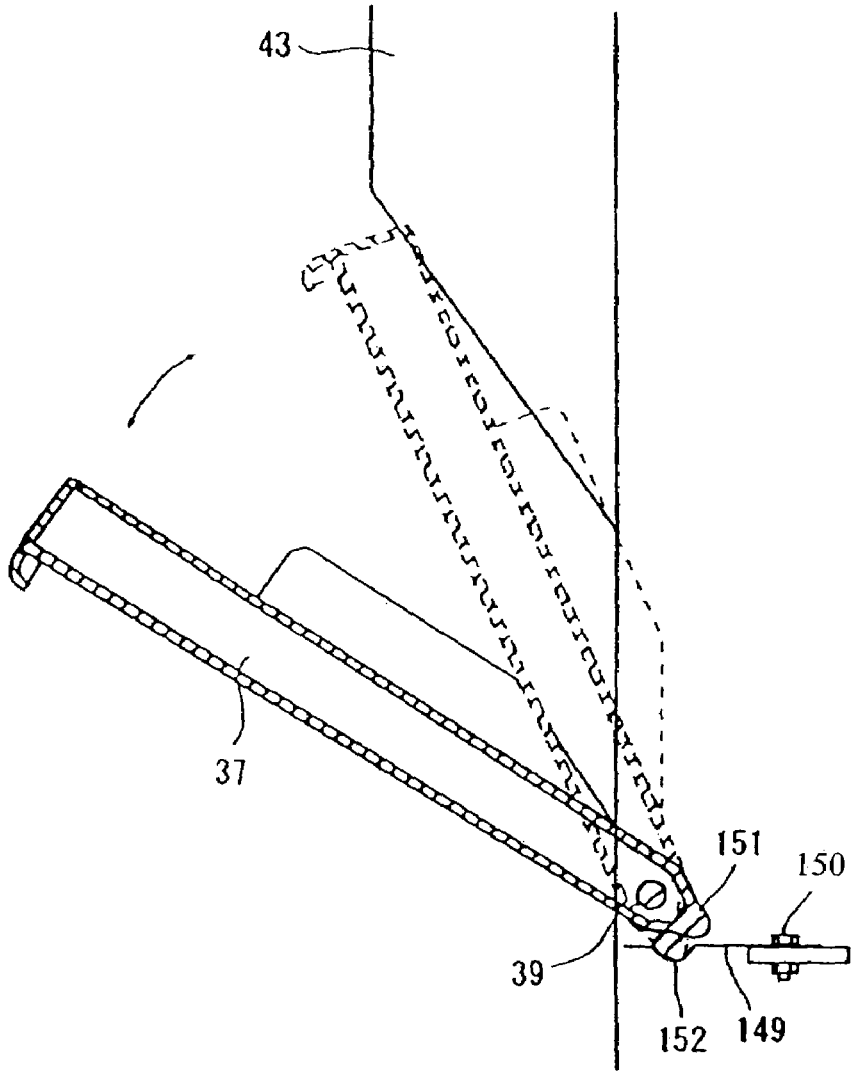
FIG. 11 is a view for describing another example where the manual paper feed tray is held by the device main body.

Moreover, as shown in FIG. 11, an engaging projection 151 can be formed on the manual paper feed tray 37 to the device main body side from the swing shaft 39. In addition, a leaf spring 149 having a curved portion 152 to be engaged with the engaging projection 151 can be fixed on the device main body frame of the device main body by a screw 150. As a result, the manual paper feed tray 37 can be held by the curved portion 152 of the leaf spring 149.

Figure 12:
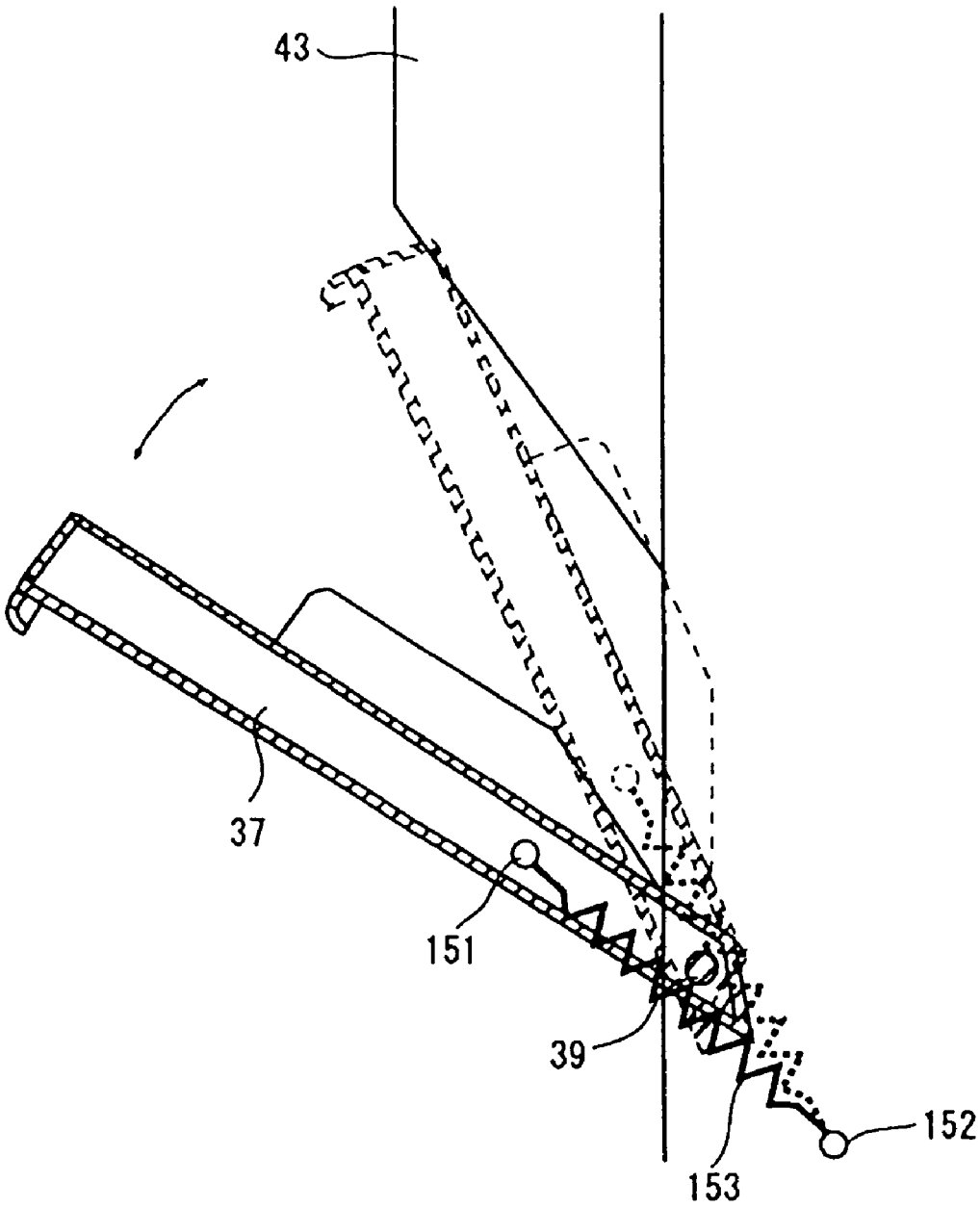
FIG. 12 is a view for describing another example where the manual paper feed tray is held by the device main body.

Moreover, as shown in FIG. 12, the engaging projection 151 can be formed at an intermediate position on the manual paper feed tray 37, and an engaging projection 152 can also be formed on the device main body. By attaching a spring 153 between the engaging projections 151 and 152, the manual paper feed tray 37 can be held at a position where the spring 153 is moved above the swing shaft 39 or at a position where the spring 153 is moved below the swing shaft 39 by the swing of the manual paper feed tray 37.

Figure 13:
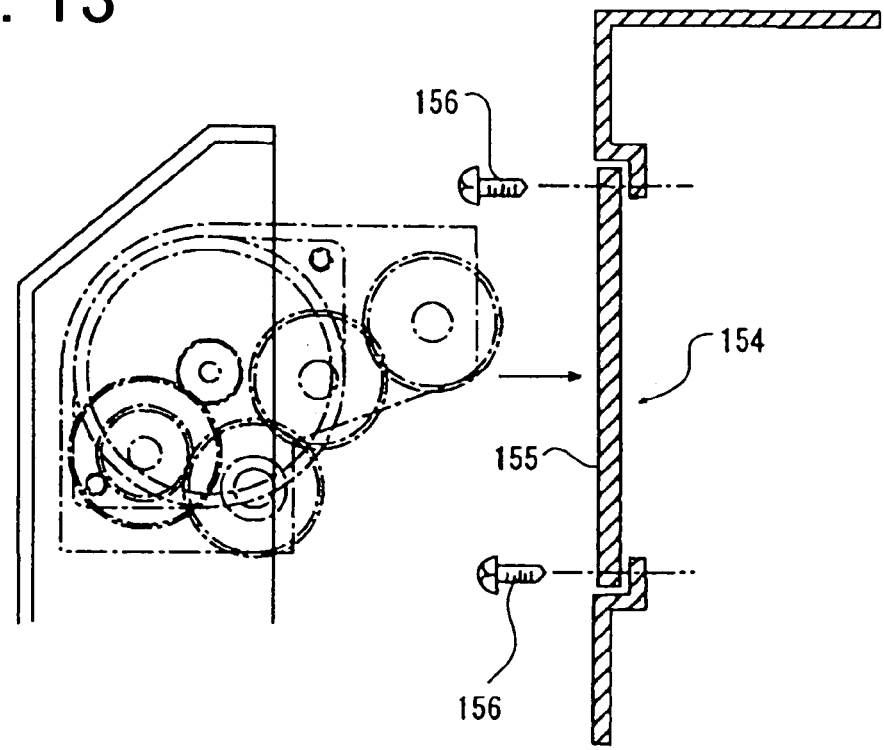
FIG. 13 is a view for describing a state in which an upper part of the reversible transportation unit is inserted into the device main body.
Figure 14:
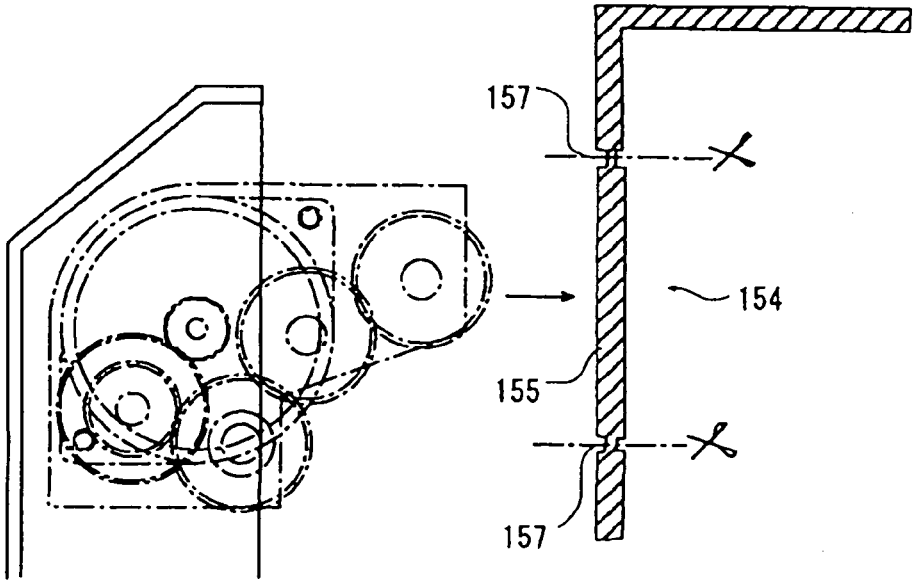
FIG. 14 is a view for describing another example of the state in which the upper part of the reversible transportation unit is inserted into the device main body.

In the upper part of the reversible transportation unit 43, as shown in FIG. 13, an opening 154 is provided at a position on the device main body where the gear supporting plate 123 attached with the motor 122 and the third transfer gear 132 or the like is inserted. In the opening 154, a cover plate 155 is mounted by screws 156. Therefore, when not inserting the reversible transportation unit 43, since the opening 154 is closed, dusts or the like can be prevented from entering the device main body. Moreover, as a method for closing the opening 154 by using other than the screws, as shown in FIG. 14, a connecting part 157 having a thickness thin enough to be cut, can be formed around the cover plate 155.

Figure 15:
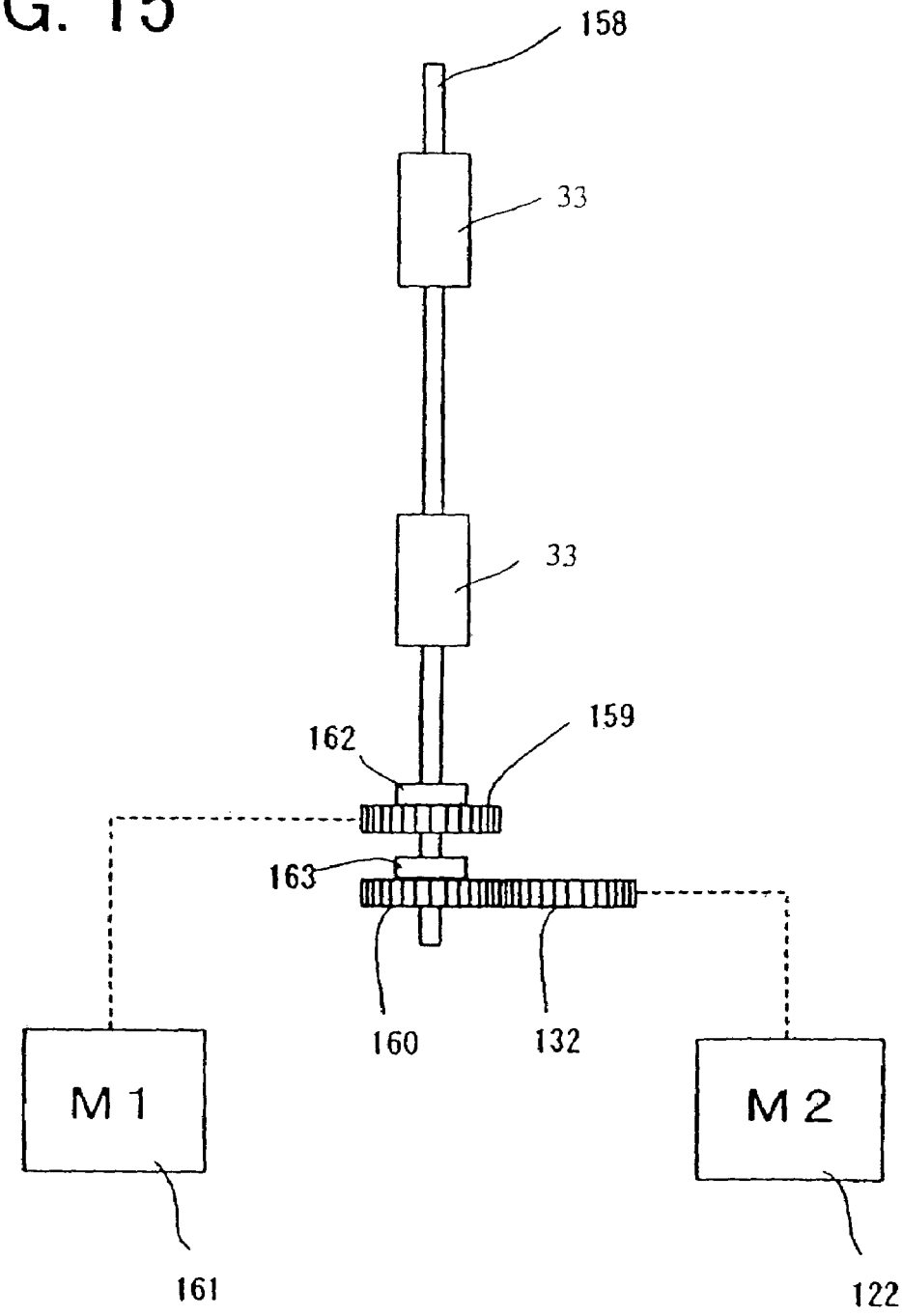
FIG. 15 is a view for describing a paper transportation driving mechanism when the reversible transportation unit is inserted.

When the reversible transportation unit 43 is inserted, as shown in FIG. 15, the third transfer gear 132 engages with a gear 160 attached on a roller shaft 158 of the discharge roller 33. The gear 160 is attached on the roller shaft 158 via a one-way clutch 163. Only when the motor 122 is rotated, the rotation of the motor 122 is transferred to the roller shaft 158 via the one-way clutch 163. Another gear 159 is attached on the roller shaft 158, and a driving force of a motor 161, which rotates and drives the transportation rollers in the device main body, is transferred to the gear 159. The gear 159 is attached on the roller shaft 158 via a one-way clutch 162. Only when the motor 161 is rotated, the rotation of the motor 161 is transferred to the roller shaft 158 via the one-way clutch 162. Therefore, when the motor 161 is rotated, the roller shaft 158 rotates by a driving force from the gear 159, the discharge roller 33 rotates and the paper is discharged to the discharge tray 35. At this time, the one-way clutch 163 idles, and the rotation of the roller shaft 158 is not affected.

Meanwhile, when the motor 122 rotates, the rotation of the motor 122 is transferred from the third transfer gear 132 to the gear 160. In this case, the gear 160 is rotated in a direction that is the opposite of when the motor 161 rotated. The clutch of the gear 160 is connected, and the roller shaft 158 rotates in a direction that is the opposite of when discharging the paper. Then, the discharge roller 33 transports the paper to the paper transportation outlet 53. At this time, the one-way clutch 162 idles, and the rotation of the roller shaft 158 is not affected. As described above, by setting the clutch connection to be made when the gears 159 and 160 are rotated in the opposite direction from one another, the paper discharge operation and the reversible transportation operation of the discharge roller 33 can be carried out by switching appropriately.

What is claimed is:

1. A duplex image forming device comprising:

an image forming device which includes a paper transportation path, a paper feed unit which transports a paper to the paper transportation path, a printing unit which prints an image onto the paper, and a discharge tray where the paper printed with the image is discharged; and a reversible transportation unit which includes a main body having a contacting surface that contacts against a side of the image forming device, a reversible transportation path which transports-in the paper from a downstream side of the printing unit and transports-out the paper to an upstream side of the printing unit in the paper transportation path, transportation rollers which transport the paper through the reversible transportation path, and a motor which drives the transportation rollers and is disposed protruding outward from the contacting surface of the main body so that at least a part of the motor is disposed in the image forming device when the reversible transportation unit is inserted into the image forming device.

2. The duplex image forming device according to claim 1, further comprising a cover member which covers the part of the motor that is protruding outward from the contacting surface.

3. The duplex image forming device according to claim 2, wherein the cover member is provided in the reversible transportation unit.

4. The duplex image forming device according to claim 1, wherein the paper transportation path is formed from the paper feed unit upward in a vertical direction and connected to the discharge tray.

5. The duplex image forming device according to claim 1, wherein the image forming device further comprises a storage opening which is provided at a side of the image forming device, a manual paper feed tray which swings between a closed position disposed at the storage opening, and an opened position disposed away from the storage opening, and a swing shaft which supports the manual paper feed tray rotatable.

6. The duplex image forming device according to claim 5, wherein the reversible transportation unit is inserted above the manual paper feed tray.

7. The duplex image forming device according to claim 6, wherein the reversible transportation unit comprises a protrusion to be inserted into the storage opening.

8. The duplex image forming device according to claim 7, wherein an upper part and a lower part of the reversible transportation path are slanted, and the transportation rollers are disposed at the slanting path, respectively.

9. The duplex image forming device according to claim 8, wherein at least a part of the transportation rollers is disposed at the protrusion.

10. The duplex image forming device according to claim 5, wherein a storage unit which stores the manual paper feed tray is formed on the main body of the reversible transportation unit.

11. The duplex image forming device according to claim 10, further comprising means for holding the manual paper feed tray under a state stored in the storage unit.

12. The duplex image forming device according to claim 1, wherein the reversible transportation unit includes a gear mechanism which transfers a drive from the motor, and a supporting plate which attaches the motor and the gear mechanism.

13. The duplex image forming device according to claim 12, wherein at least a part of the gear mechanism is disposed outward from the contacting surface.

14. The duplex image forming device according to claim 1, wherein the image forming device further comprises an opening formed at the side of the image forming device for inserting the part that is protruding outward from the contacting surface of the motor.

15. The duplex image forming device according to claim 14, wherein the image forming device further comprises a cover plate which covers the opening.

16. A reversible transportation unit inserted into an image forming device, comprising:

a main body frame which has a contacting surface that contacts against a side of the image forming device;

a reversible transportation path which transports-in a paper from a downstream side of a printing unit of a paper transportation path of the image forming device and transports-out the paper to an upstream side of the printing unit;

transportation rollers which transport the paper in the reversible transportation path; and a motor which drives the transportation rollers and is disposed protruding outward from the contacting surface of the main body frame so that at least a part of the motor is disposed in the image forming device when the reversible transportation unit is inserted into the image forming device.

17. The reversible transportation unit according to claim 16, further comprising a cover member which covers the part that is protruding outward from the contacting surface of the motor.

18. The reversible transportation unit according to claim 16, wherein the image forming device comprises a manual paper feed tray, and the reversible transportation unit is inserted above the manual paper feed tray.

19. The reversible transportation unit according to claim 18, wherein the image forming device comprises a storage unit which is disposed at a side of the image forming device and stores the manual paper feed tray, and the reversible transportation unit further comprises a protrusion to be inserted into a storage opening.

20. The reversible transportation unit according to claim 19, wherein an upper part and a lower part of the reversible transportation path are slanting, and the transportation rollers are disposed at the slanting path, respectively.

21. The reversible transportation unit according to claim 20, wherein at least a part of the transportation rollers is disposed at the protrusion.

22. The reversible transportation unit according to claim 18, wherein a storage unit is formed on the main body frame for storing the manual paper feed tray.

23. The reversible transportation unit according to claim 22, further comprising means for supporting the manual paper feed tray under a stored state in the storage unit.

24. The reversible transportation unit according to claim 16, further comprising:

a gear mechanism which transfers a drive from the motor; and a supporting plate which attaches the motor and the gear mechanism.

25. The reversible transportation unit according to claim 24, wherein at least a part of the gear mechanism is disposed outward from the contacting surface.

26. An image forming device which a reversible transportation unit is inserted therein, comprising:

a paper transportation path;

a paper feed unit which transports a paper to the paper transportation path;

a printing unit which prints an image onto the paper;

a discharge tray where the paper printed with the image is discharged; and an opening which is formed on a side where the reversible transportation unit is inserted in contact with the image forming device, and a part protruding outward from the contacting surface of a motor of the reversible transportation unit is inserted into the opening.

27. The image forming device according to claim 26, further comprising a cover plate which covers the opening.

28. The image forming device according to claim 26, wherein the paper transportation path is formed from the paper feed unit upward in a vertical direction and connected to the discharge tray.

29. The image forming device according to claim 26, further comprising:

a storage opening which is provided at a side of the image forming device;

a manual paper feed tray which swings between a closed position disposed at the storage opening and an opened position disposed away from the storage opening; and a swing shaft which supports the manual paper feed tray rotatable.

* * * * *